US006095911A

United States Patent [19]

Edens

[11] Patent Number: 6,095,911

[45] Date of Patent: Aug. 1, 2000

[54] DRYWALL SANDING TOOL

[76] Inventor: Joseph C. Edens, 4025 Motorway Dr., Waterford, Mich. 48328

[21] Appl. No.: 09/118,490

[22] Filed: Jul. 17, 1998

Related U.S. Application Data

[60] Provisional application No. 60/053,237, Jul. 18, 1997.

[51] Int. Cl.[7] ..... B24B 23/00; B24B 27/08

[52] U.S. Cl. ..... 451/524; 451/354; 451/523

[58] Field of Search ..... 451/523, 524, 451/525, 354, 231, 232

[56] References Cited

U.S. PATENT DOCUMENTS

| | | | |
|---|---|---|---|
| 3,123,946 | 3/1964 | J.C. Hoveland | 451/524 |
| 3,483,662 | 12/1969 | R.G. Ames | 451/524 |
| 3,488,897 | 1/1970 | Taafe, Jr. | 451/342 |
| 3,540,160 | 11/1970 | A. De Rose et al. | 451/523 |
| 4,330,964 | 5/1982 | Martinez | 451/342 |
| 4,516,361 | 5/1985 | Gringer | 451/524 |
| 4,885,876 | 12/1989 | Henke | 451/525 |
| 5,634,843 | 6/1997 | Liu | 451/524 |

*Primary Examiner*—Derris H. Banks
*Attorney, Agent, or Firm*—John R Benefiel

[57] ABSTRACT

An oversized drywall sanding tool for sanding joints has a recess for receiving a conventionally sized sander and has a thick cushioning pad mounted to the base piece to allow large areas to be sanded flat.

2 Claims, 1 Drawing Sheet

DRYWALL SANDING TOOL

CROSS-REFERENCE TO RELATED APPLICATION

This application claims priority with respect to Provisional application Ser. No. 60/053,237 filed on Jul. 18, 1997.

BACKGROUND OF THE INVENTION

This invention concerns sanding tools and more particularly dry-wall sanders for sanding taped joints, outside corners, filled nail holes, etc. A standard drywall sander comprises a rectangular base member to which is clamped a strip of sandpaper, the exposed portion of the sandpaper on the bottom of the base member measuring approximately 3 inches by 9 inches.

A larger size sanding plane would be desirable particularly for taped joints in that less sanding would be required and a smoother joint would result. The taped joints comprise a fairly wide area which requires repeated sanding with the standard sander, and it is difficult to obtain a perfectly smooth joint.

U.S. Pat. No. 5,103,599 issued on Apr. 14, 1992 for a "Super Flat Sander" describes an oversized sander base attachable to a standard sized sander by being affixed to the rear face.

However, it has been discovered that the oversize sander is difficult to use, particularly where the standard size is sander is stacked onto the rear face, as the sanding motion differs, making sanding more awkward. There is also a great tendency to score the surface with an edge of the sander when using an oversized sander. That tool presents a perfectly flat sanding surface which cannot accommodate the inevitable unevenness around outside corners, fixture boxes, etc. This is also true to some extent of standard sized drywall sanders. Thus, the tool of U.S. Pat. No. 5,103,599 is largely used only for touch up of critical areas, and does not help in speeding the job.

The object of the present invention is to provide an oversized drywall sanding tool which handles the same as a standard sized sander, but is very effective in achieving smooth joints, and does not have a tendency to cut or score the surface.

SUMMARY OF THE INVENTION

This object is achieved by an oversized rectangular sander base piece having a recess in the rear face sized to receive and be interfit with a standard sander base member, the oversized sander base piece being approximately 5–6 inches wide and 11 inches long.

A thick resilient pad (approximately one half inch thick) overlies the bottom face of the sander base piece, and a piece of sand paper is clamped over the thick pad.

The pad is folded up over the ends of the base piece, and the sand paper base is wrapped over these ends and onto the top of the base piece.

The thick pad improves the effectiveness of a sander by greatly reducing the tendency to score the surface and to allow working on uneven surfaces, as the pad will accommodate typical unevenness.

The combination of the thick pad with an oversized sander allows very effective sanding of wide areas and uneven surfaces, such as outside corners, without any tendency for scoring the surface.

The recessed mounting of the standard sander allows a motion very similar to that used with conventional sanders, to eliminate the awkwardness associated with the prior art oversized "piggybacked" sander.

DESCRIPTION OF THE DRAWING FIGURES

DETAILED DESCRIPTION

Figure 1:
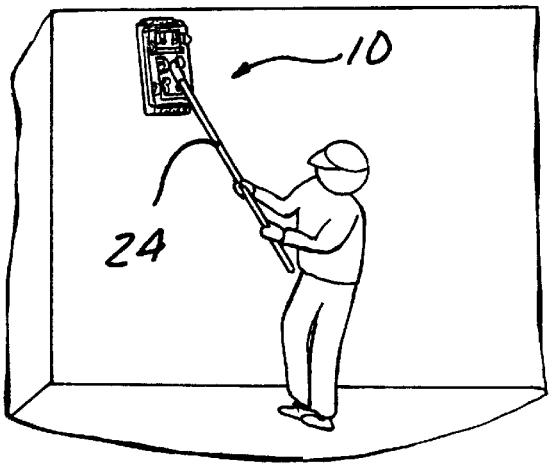
FIG. 1 is a perspective view of a drywall sander according to the present invention being used.
Figure 2:
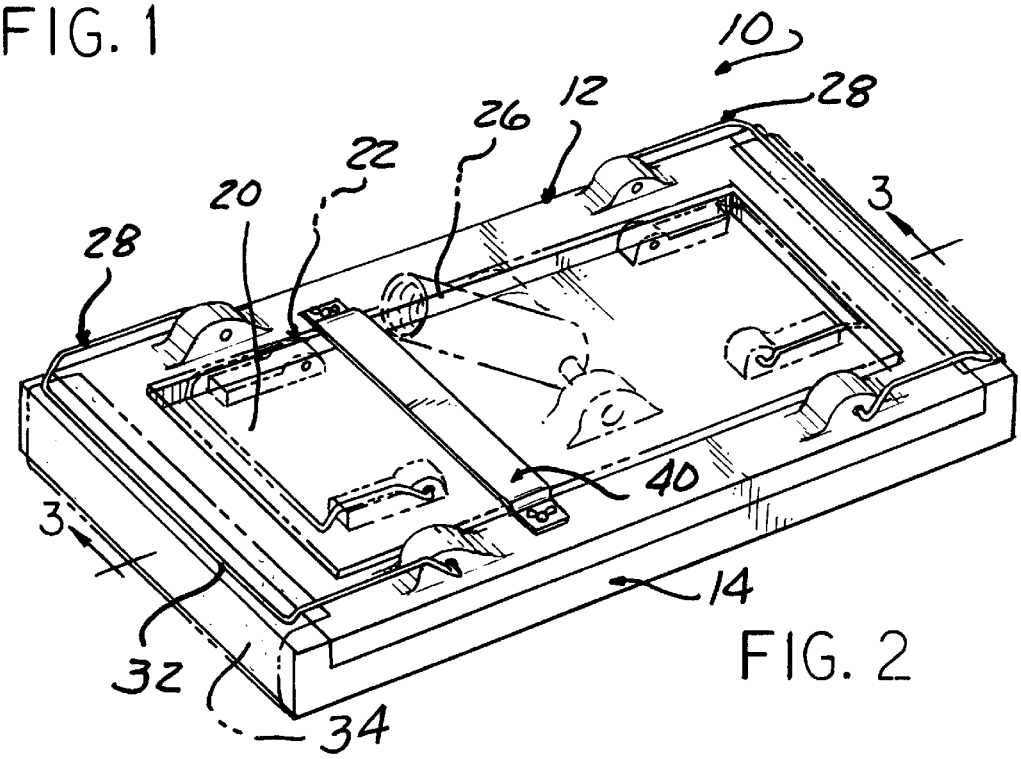
FIG. 2 is a enlarged perspective view of a dry wall sander base piece with a standard, conventional sanding pad interfit thereto, shown in phantom lines.
Figure 3:
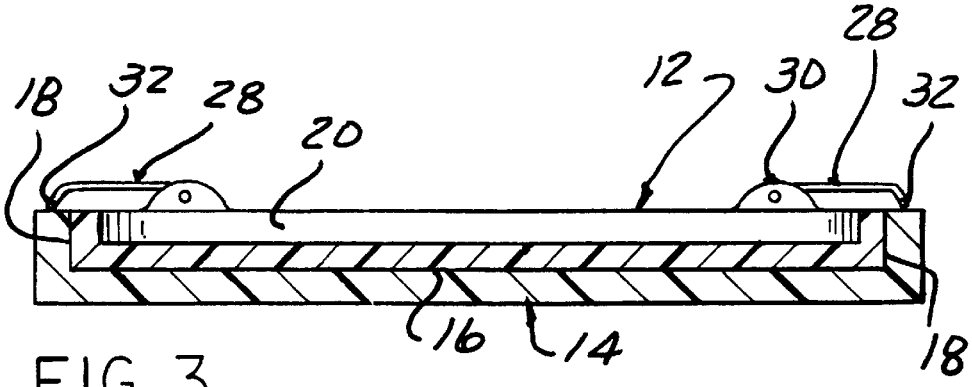
FIG. 3 is a view of the section 3—3 in FIG. 2.

Referring to the drawings, the drywall sanding tool 10 according to the present invention comprises a sander base piece 12 of a flat rectangular shape, of a substantially larger size than the standard sanding pad, i.e., of a size on the order of 5 to 6 inches wide by 11 inches long. The base piece 12 is preferably molded from a stiff plastic and may also be ribbed or of grid configuration to produce a rigid structure.

A relatively thick layer of a soft resilient pad 14, i.e. on the order of one half inch thick, is bonded or otherwise affixed to the bottom surface 16 of the rigid base piece 12, also preferably folded up over the ends 18 of the base piece 12 as shown to act as a bumper protecting the walls from being dented. The pad 14 may be constructed of a soft foamed soft plastic ideally slightly stiffer than carpet pad, but slightly softer than typical foam rubber kneeling pads.

The base piece 12 is also provided with a rectangular recess 20 of dimensions allowing a standard sander 22 to be interfit into the recess 20, i.e., slightly greater than 3 by 9 inches, and of a depth on the order of ½ inch. A pole 24 is threadable into the socket 26 of most standard drywall sanders.

A pair of wire bails 28 are mounted in respective sets of spring pivot mounts 30 which each have segments 32 urged down onto an end of a sandpaper strip wrapped over the cushioning pad 14.

One or more securement strips 40 spanning the recess 20 may be provided to hold the conventional sander base member 22 in place.

The sander 10 can be used in a conventional manner to sand joints, the recessed location of the conventional sander base member 22 and the presence of the cushioning pad allowing sanding with a much larger sized paper without scoring, and enabling most joints to be quickly finished to a very flat condition.

The thick cushioning pad 14 yields a much more effective sander, as sanding pressure may be easily controlled from light pressure for nail holes, to heavy pressure for taped joints; and, the tendency to score the surface is greatly reduced, even when working on uneven surfaces, as at outside corners, fixtures and switchboxes, etc.

The thick cushioning pad may also be advantageously used with conventional sanders.

What is claimed is:

1. A method of sanding a drywall joint, comprising the steps of forming a rectangular base piece with a recess able to have a conventional sander fit therein, said base piece substantially larger than the base of a standard sized 3×9 inch sander;

mounting a resilient cushioning pad to the base piece;

mounting an oversized piece of sandpaper over the cushioning pad;

inserting a pole mounted conventional sander base into said base piece recess; and, carrying out sanding of a drywall joint by stroking said mounted oversized piece of sandpaper on said joint.

2. The method according to claim 1 wherein said pad is wrapped onto the ends of said base piece and said sandpaper is wrapped around ends of said cushioning pad.

* * * * *